US010105955B2

(12) United States Patent
Komplin et al.

(10) Patent No.: US 10,105,955 B2
(45) **Date of Patent: *Oct. 23, 2018**

(54) FLUIDIC DISPENSING DEVICE HAVING A MOVEABLE STIR BAR

(71) Applicant: FUNAI ELECTRIC CO., LTD., Osaka (JP)

(72) Inventors: Steven R. Komplin, Lexington, KY (US); James D. Anderson, Jr., Harrodsburg, KY (US); William D. Hall, Jr., Mt. Sterling, KY (US)

(73) Assignee: FUNAI ELECTRIC CO., LTD. (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/239,113

(22) Filed: Aug. 17, 2016

(65) Prior Publication Data

US 2018/0050542 A1 Feb. 22, 2018

(51) Int. Cl.
*B41J 2/17* (2006.01)
*B41J 2/14* (2006.01)

(52) U.S. Cl.
CPC ..... *B41J 2/1707* (2013.01); *B41J 2/1433* (2013.01); *B41J 2002/14193* (2013.01); *B41J 2202/13* (2013.01)

(58) Field of Classification Search
CPC ..... B41J 2/1707; B41J 2002/14193; B41J 2002/13
See application file for complete search history.

(56) References Cited

U.S. PATENT DOCUMENTS

| | | | | |
|---|---|---|---|---|
| 4,893,738 | A * | 1/1990 | Gelinas | B05C 11/10 222/309 |
| 5,198,156 | A | 3/1993 | Middleton et al. | |
| 6,332,676 | B1 | 12/2001 | Santhanam | |
| 7,172,272 | B2 | 2/2007 | Tsuchiya et al. | |
| 8,608,300 | B2 | 12/2013 | Igawa et al. | |
| 9,707,767 | B1 * | 7/2017 | Komplin | B41J 2/175 |
| 2001/0013886 | A1 | 8/2001 | Underwood et al. | |
| 2001/0015742 | A1 | 8/2001 | Childers | |
| 2001/0024225 | A1 | 9/2001 | Ishizawa et al. | |
| 2001/0030675 | A1 | 10/2001 | Kobayashi et al. | |
| 2002/0012026 | A1 | 1/2002 | Kubota et al. | |

(Continued)

FOREIGN PATENT DOCUMENTS

| | | | |
|---|---|---|---|
| EP | 2919072 | A1 | 9/2015 |
| JP | 2006235470 | A | 9/2006 |

*Primary Examiner* — Sharon A Polk
(74) *Attorney, Agent, or Firm* — Aust IP Law

(57) ABSTRACT

A fluidic dispensing device includes a housing having an exterior wall and a fluid reservoir. The exterior wall has a chip mounting surface defining a first plane and has a first opening. The fluid reservoir is in fluid communication with the first opening. An ejection chip is mounted to the chip mounting surface. The ejection chip is in fluid communication with the first opening. The ejection chip has a plurality of ejection nozzles oriented such that a fluid ejection direction is substantially orthogonal to the first plane. A stir bar is moveably confined within the fluid reservoir. The stir bar has a plurality of paddles and a rotational axis, with each of the plurality of paddles having a free end tip that intermittently faces toward the first opening that is in fluid communication with the ejection chip as the stir bar is rotated about the rotational axis.

10 Claims, 10 Drawing Sheets

(56) References Cited

U.S. PATENT DOCUMENTS

| | | | |
|---|---|---|---|
| 2002/0089576 | A1 | 7/2002 | Ishizawa et al. |
| 2002/0109760 | A1 | 8/2002 | Miyazawa et al. |
| 2002/0154570 | A1 | 10/2002 | Gebrian |
| 2002/0167555 | A1 | 11/2002 | Miura et al. |
| 2003/0042274 | A1 | 3/2003 | Johanson |
| 2003/0072216 | A1 | 4/2003 | Araki |
| 2003/0107950 | A1 | 6/2003 | Shepherd et al. |
| 2004/0051766 | A1 | 3/2004 | Miyazawa et al. |
| 2004/0095842 | A1 | 5/2004 | Weetman |
| 2004/0104984 | A1 | 6/2004 | Hall et al. |
| 2005/0046682 | A1 | 3/2005 | Kawamoto |
| 2005/0093211 | A1 | 5/2005 | Shiraishi et al. |
| 2005/0248634 | A1 | 11/2005 | Aruga |
| 2006/0071989 | A1 | 4/2006 | Lewey et al. |
| 2006/0268080 | A1 | 11/2006 | Nakazawa |
| 2006/0290753 | A1 | 12/2006 | Tatsumi et al. |
| 2007/0019047 | A1 | 1/2007 | Kleinert et al. |
| 2007/0052771 | A1 | 3/2007 | Inoue et al. |
| 2007/0052773 | A1 | 3/2007 | Kawamura et al. |
| 2007/0165485 | A1 | 7/2007 | Cai |
| 2007/0188563 | A1 | 8/2007 | Takahashi |
| 2007/0242114 | A1 | 10/2007 | Kubota et al. |
| 2008/0031088 | A1 | 2/2008 | Ukita |
| 2008/0165233 | A1 | 7/2008 | Lin et al. |
| 2008/0186368 | A1 | 8/2008 | Silverbrook et al. |
| 2009/0033725 | A1 | 2/2009 | Toba et al. |
| 2009/0079802 | A1 | 3/2009 | Ito |
| 2009/0122121 | A1 | 5/2009 | Kawasaki et al. |
| 2009/0189931 | A1 | 7/2009 | Noro et al. |
| 2009/0213159 | A1 | 8/2009 | Aoki et al. |
| 2009/0251517 | A1 | 10/2009 | Matsumoto |
| 2009/0289976 | A1 | 11/2009 | Nishimura |
| 2009/0322840 | A1 | 12/2009 | Wanibe |
| 2010/0103233 | A1 | 4/2010 | Akatsuka et al. |
| 2011/0280098 | A1 | 11/2011 | Shiono |
| 2012/0000645 | A1 | 1/2012 | Willimczik |
| 2012/0056948 | A1 | 3/2012 | Kim et al. |
| 2012/0062523 | A1 | 3/2012 | Park et al. |
| 2012/0075364 | A1 | 3/2012 | Nakazawa |
| 2012/0105555 | A1 | 5/2012 | Mcfarland et al. |
| 2012/0140003 | A1 | 6/2012 | Szusdziara et al. |
| 2012/0200645 | A1 | 8/2012 | Okina |
| 2012/0200649 | A1 | 8/2012 | Igawa et al. |
| 2013/0342618 | A1 | 12/2013 | Frasure et al. |
| 2014/0061961 | A1 | 3/2014 | Ishizawa et al. |
| 2014/0098146 | A1 | 4/2014 | Kamiyama |
| 2015/0165399 | A1 | 6/2015 | Rawlings |
| 2015/0343784 | A1 | 12/2015 | Anderson, Jr. et al. |

* cited by examiner

FLUIDIC DISPENSING DEVICE HAVING A MOVEABLE STIR BAR

CROSS-REFERENCE TO RELATED APPLICATIONS

This application is related to U.S. patent application Ser. No. 15/183,666, now U.S. Pat. No. 9,744,771; Ser. No. 15/183,693, now U.S. Pat. No. 9,707,767; Ser. No. 15/183,705, now U.S. Pat. No. 9,751,315; Ser. No. 15/183,722, now U.S. Pat. No. 9,751,316; Ser. Nos. 15/183,736; 15/193,476; 15/216,104, now U.S. Pat. No. 9,908,335; Ser. No. 15/256,065, now U.S. Pat. No. 9,688,074; Ser. No. 15/278,369, now U.S. Pat. No. 9,931,851; Ser. Nos. 15/373,123; 15/373,243; 15/373,635, now U.S. Pat. No. 9,902,158; Ser. No. 15/373,684, now U.S. Pat. No. 9,889,670; and Ser. No. 15/435,983, now U.S. Pat. No. 9,937,725.

BACKGROUND OF THE INVENTION

1. Field of the Invention

The present invention relates to fluidic dispensing devices, and, more particularly, to a fluidic dispensing device, such as a microfluidic dispensing device, that carries a fluid for ejection, and having a moveable stir bar for mixing the fluid in the fluidic dispensing device.

2. Description of the Related Art

One type of microfluidic dispensing device, such as an ink jet printhead, is designed to include a capillary member, such as foam or felt, to control backpressure. In this type of printhead, the only free fluid is present between a filter and the ejection device. If settling or separation of the fluid occurs, it is almost impossible to re-mix the fluid contained in the capillary member.

Another type of printhead is referred to in the art as a free fluid style printhead, which has a moveable wall that is spring loaded to maintain backpressure at the nozzles of the printhead. One type of spring loaded moveable wall uses a deformable deflection bladder to create the spring and wall in a single piece. An early printhead design by Hewlett-Packard Company used a circular deformable rubber part in the form of a thimble shaped bladder positioned between a lid and a body that contained ink. The deflection of the thimble shaped bladder collapsed on itself. The thimble shaped bladder maintained backpressure by deforming the bladder material as ink was delivered to the printhead chip.

In a fluid tank where separation of fluids and particulate may occur, it is desirable to provide a mixing of the fluid. For example, particulate in pigmented fluids tend to settle depending on particle size, specific gravity differences, and fluid viscosity. U.S. Patent Application Publication No. 2006/0268080 discloses a system having an ink tank located remotely from the fluid ejection device, wherein the ink tank contains a magnetic rotor, which is rotated by an external rotary plate, to provide bulk mixing in the remote ink tank.

It has been recognized, however, that a microfluidic dispensing device having a compact design, which includes both a fluid reservoir and an on-board fluid ejection chip, presents particular challenges that a simple agitation in a remote tank does not address. For example, it has been determined that not only does fluid in the bulk region of the fluid reservoir need to be remixed, but remixing in the ejection chip region also is desirable, and in some cases, may be necessary, in order to prevent the clogging of the region near the fluid ejection chip with settled particulate.

What is needed in the art is a fluidic dispensing device having a moveable stir bar that provides for both bulk fluid remixing and fluid remixing in the vicinity of the fluid ejection chip.

SUMMARY OF THE INVENTION

The present invention provides a fluidic dispensing device having a moveable stir bar that facilitates both bulk fluid remixing and fluid remixing in the vicinity of the fluid ejection chip.

The invention, in one form, is directed to a fluidic dispensing device, including a housing having an exterior wall and a fluid reservoir. The exterior wall has a chip mounting surface defining a first plane and has a first opening. The fluid reservoir is in fluid communication with the first opening. An ejection chip is mounted to the chip mounting surface of the housing. The ejection chip is in fluid communication with the first opening. The ejection chip has a plurality of ejection nozzles oriented such that a fluid ejection direction is substantially orthogonal to the first plane. A stir bar is moveably confined within the fluid reservoir. The stir bar has a plurality of paddles and a rotational axis, with each of the plurality of paddles having a free end tip that intermittently faces toward the first opening that is in fluid communication with the ejection chip as the stir bar is rotated about the rotational axis.

The invention, in another form, is directed to a fluidic dispensing device, including a housing having an exterior wall and a chamber. The exterior wall has a first opening. The chamber has an interior space and has a port coupled in fluid communication with the first opening. A stir bar is located in the chamber, and has a rotational axis. A guide portion is located in the chamber. The guide portion includes a confining member having a guide opening that defines an interior radial confining surface that engages the stir bar. The guide opening facilitates a radial movement of the stir bar in a direction substantially perpendicular to the rotational axis.

The invention, in another form, is directed to a microfluidic dispensing device, including a housing having a fluid reservoir and a first opening. The fluid reservoir is coupled in fluid communication with the first opening. A stir bar is located in the fluid reservoir. The stir bar has a first portion, a second portion, and a rotational axis. The first portion has a first radial extent and the second portion has a second radial extent, with the first radial extent being greater than the second radial extent. A guide portion is located in the fluid reservoir. The guide portion includes a confining member having an axial confining surface and a guide opening that defines an interior radial confining surface. The axial confining surface is axially displaced from the base wall along the rotational axis. The first portion of the stir bar is positioned between the axial confining surface and the base wall. The second portion of the stir bar is received in the guide opening to facilitate radial movement of the stir bar in a direction substantially perpendicular to the rotational axis.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
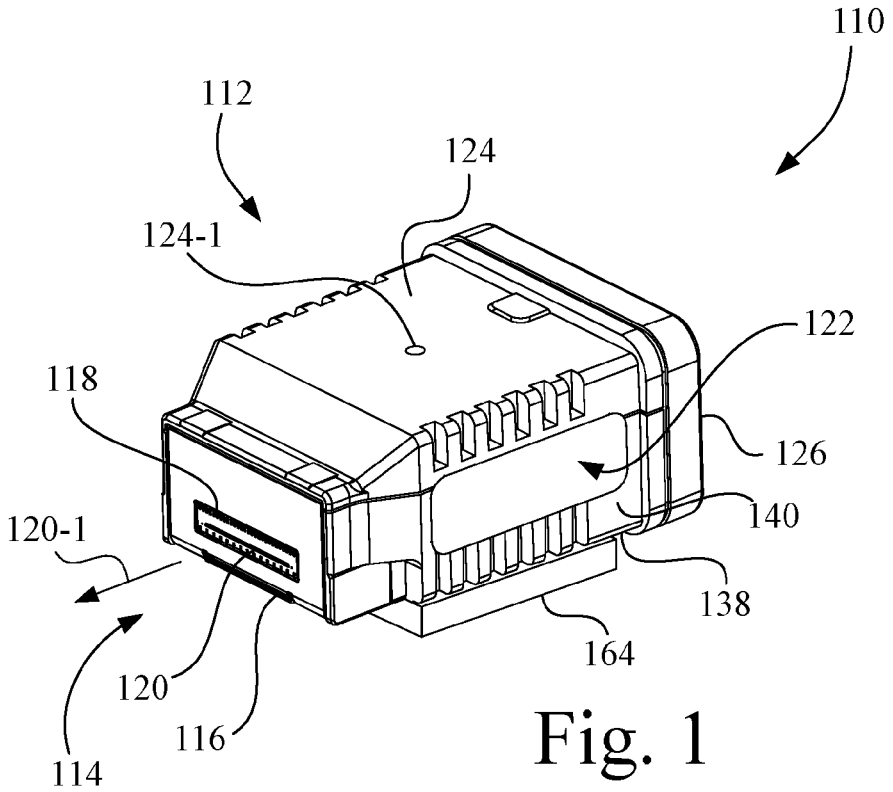
FIG. 1 is a perspective view of an embodiment of a microfluidic dispensing device in accordance with the present invention, in an environment that includes an external magnetic field generator.
Figure 2:
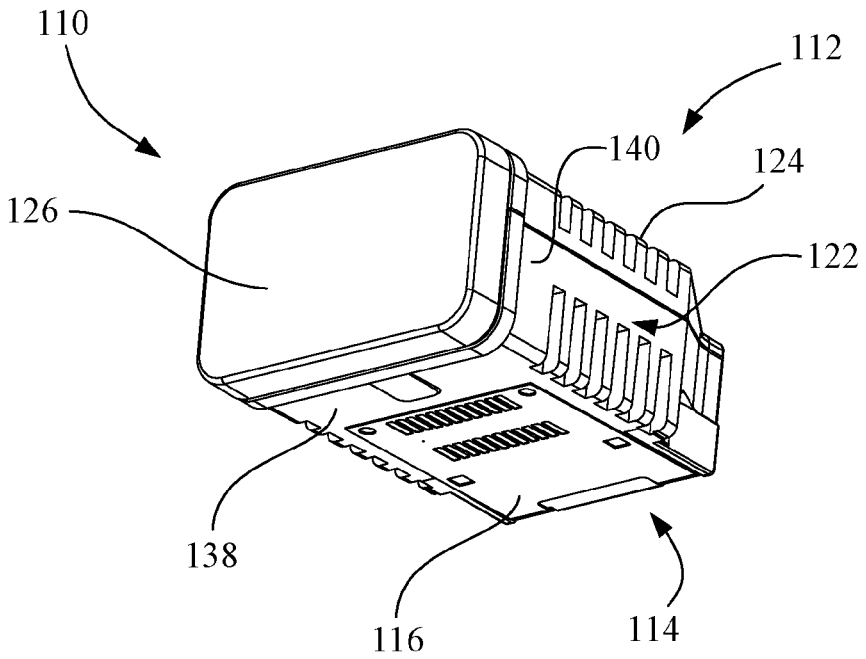
FIG. 2 is another perspective view of the microfluidic dispensing device of FIG. 1.
Figure 3:
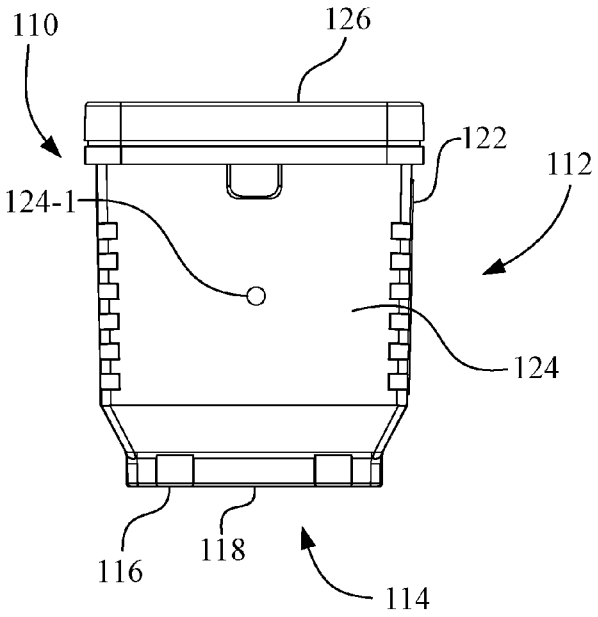
FIG. 3 is a top orthogonal view of the microfluidic dispensing device of FIGS. 1 and 2.
Figure 4:
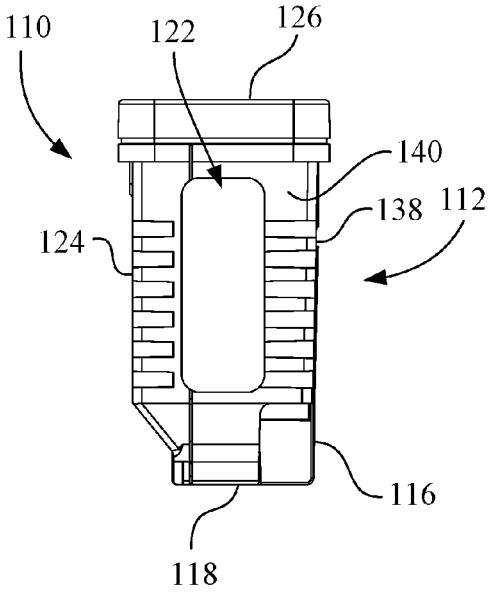
FIG. 4 is a side orthogonal view of the microfluidic dispensing device of FIGS. 1 and 2.
Figure 5:
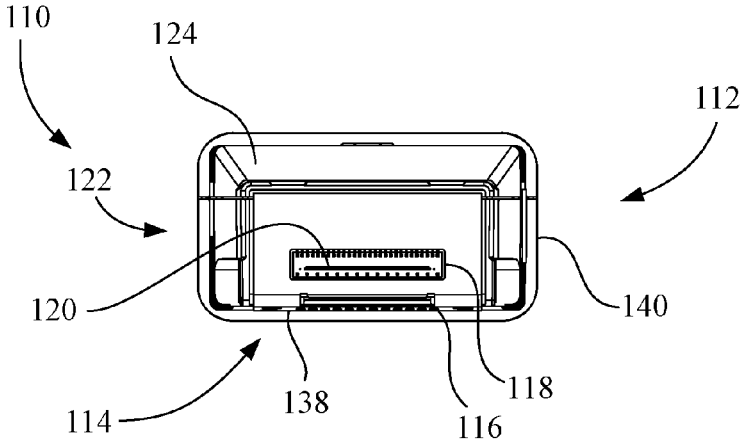
FIG. 5 is an end orthogonal view of the microfluidic dispensing device of FIGS. 1 and 2.

Referring now to the drawings, and more particularly to FIGS. 1-10, there is shown a fluidic dispensing device, which in the present example is a microfluidic dispensing device 110 in accordance with an embodiment of the present invention.

Referring to FIGS. 1-5, microfluidic dispensing device 110 generally includes a housing 112 and a tape automated bonding (TAB) circuit 114. Microfluidic dispensing device 110 is configured to contain a supply of a fluid, such as a fluid containing particulate material, and TAB circuit 114 is configured to facilitate the ejection of the fluid from housing 112. The fluid may be, for example, cosmetics, lubricants, paint, ink, etc.

TAB circuit 114 includes a flex circuit 116 to which an ejection chip 118 is mechanically and electrically connected. Flex circuit 116 provides electrical connection to an electrical driver device (not shown), such as an ink jet printer, configured to operate ejection chip 118 to eject the fluid that is contained within housing 112. In the present embodiment, ejection chip 118 is configured as a plate-like structure having a planar extent formed generally as a nozzle plate layer and a silicon layer, as is well known in the art. The nozzle plate layer of ejection chip 118 has a plurality of ejection nozzles 120 oriented such that a fluid ejection direction 120-1 is substantially orthogonal to the planar extent of ejection chip 118. Associated with each of the ejection nozzles 120, at the silicon layer of ejection chip 118, is an ejection mechanism, such as an electrical heater (thermal) or piezoelectric (electromechanical) device. The operation of such an ejection chip 118 and driver is well known in the micro-fluid ejection arts, such as in ink jet printing.

As used herein, each of the terms substantially orthogonal and substantially perpendicular is defined to mean an angular relationship between two elements of 90 degrees, plus or minus 10 degrees. The term substantially parallel is defined to mean an angular relationship between two elements of zero degrees, plus or minus 10 degrees.

Figure 6:
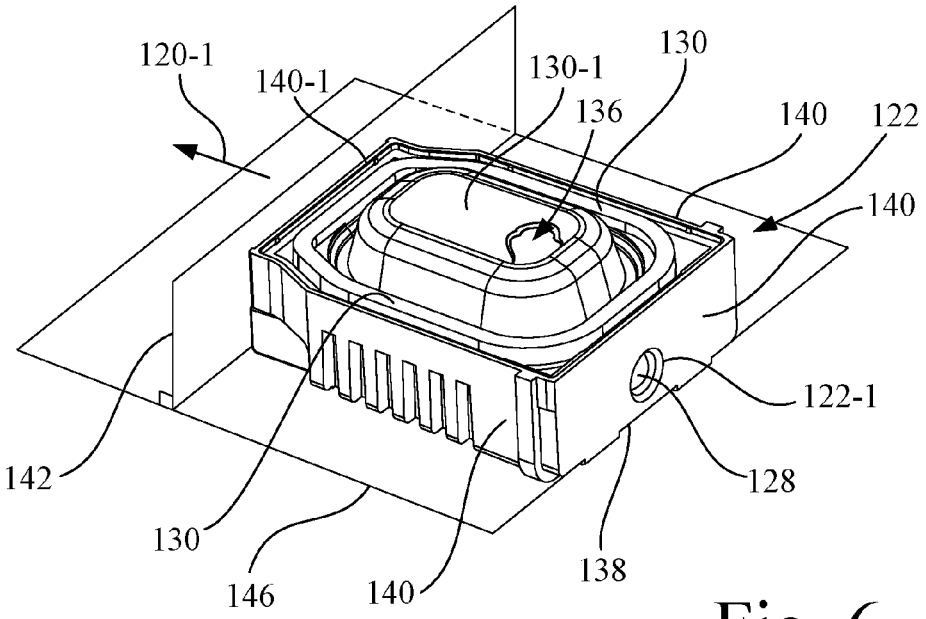
FIG. 6 is a perspective view of the microfluidic dispensing device of FIG. 1, with the end cap and lid removed to expose the body/diaphragm assembly, in relation to first and second planes and to the fluid ejection direction, and with a portion of the diaphragm broken away to illustrate the fluid reservoir.
Figure 7:
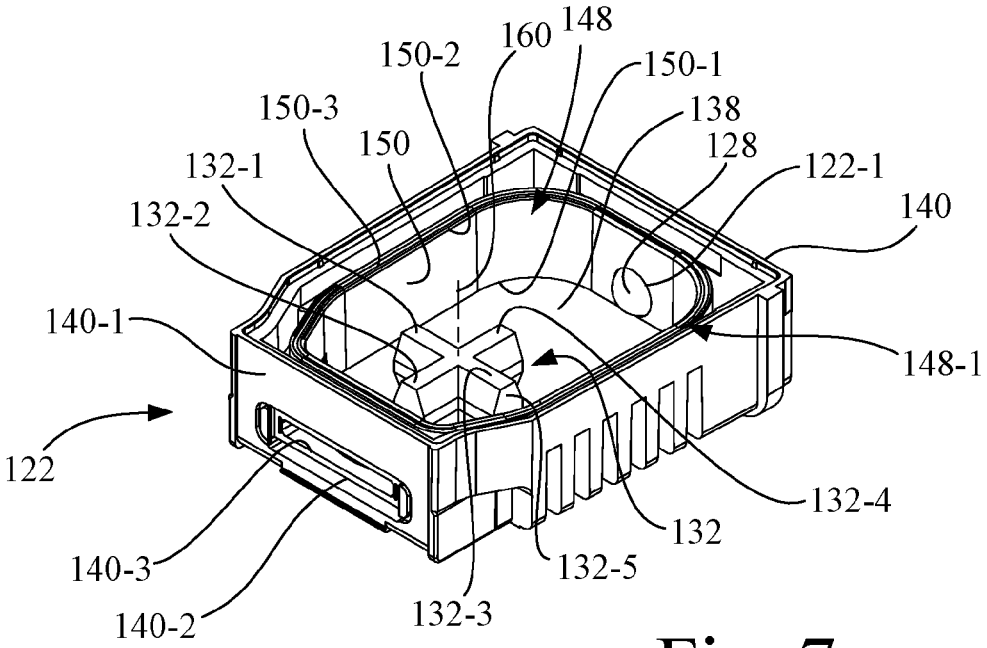
FIG. 7 is a perspective view of the depiction of FIG. 6, with the diaphragm removed to expose the stir bar contained in the body, and the ejection chip removed to expose the fluid opening in the exterior wall.

Referring to FIGS. 1-5, housing 112 includes a body 122, a lid 124, and an end cap 126. Referring to FIGS. 6 and 7, body 122 includes a fill hole 122-1 and a fill plug 128 (e.g., ball). In the present embodiment, fill plug 128 may be in the form of a stainless steel ball bearing. Referring to FIGS. 6-10, contained within housing 112 is a diaphragm 130 and a stir bar 132. Each of the housing 112 components and stir bar 132 may be made of plastic, using a molding process. Diaphragm 130 is made of rubber, using a molding process.

In general, a fluid (not shown) is loaded through a fill hole 122-1 in body 122 (see FIGS. 6-8) into a sealed region, i.e., a fluid reservoir 136, between body 122 and diaphragm 130. Back pressure in fluid reservoir 136 is set and then maintained by inserting, e.g., pressing, fill plug 128 into fill hole 122-1 to prevent air from leaking into fluid reservoir 136 or fluid from leaking out of fluid reservoir 136. Referring again to FIGS. 1-5, end cap 126 is then placed onto an end of the body 122/lid 124 combination, opposite to ejection chip 118. Stir bar 132 resides in the sealed fluid reservoir 136 between body 122 and diaphragm 130 that contains the fluid. An internal fluid flow may be generated within fluid reservoir 136 by rotating stir bar 132 so as to provide fluid mixing and redistribution of particulate in the fluid within the sealed region of fluid reservoir 136.

Referring to FIGS. 6-10, body 122 of housing 112 has a base wall 138 and an exterior perimeter wall 140 contiguous with base wall 138. Exterior perimeter wall 140 is oriented to extend from base wall 138 in a direction that is substantially orthogonal to base wall 138. Referring again to FIGS. 1-5, lid 124 is configured to engage exterior perimeter wall 140. Thus, exterior perimeter wall 140 is interposed between base wall 138 and lid 124, with lid 124 being attached to the open free end of exterior perimeter wall 140 by weld, adhesive, or other fastening mechanism, such as a snap fit or threaded union. Attachment of lid 124 to body 122 occurs after installation of diaphragm 130 (see FIG. 6) and stir bar 132 (see FIG. 7) in body 122.

Referring to FIGS. 6-10, exterior perimeter wall 140 of body 122 includes an exterior wall 140-1, which is a contiguous portion of exterior perimeter wall 140. As best shown in FIG. 7, exterior wall 140-1 has a chip mounting surface 140-2 that defines a plane 142 (see also FIG. 6), and has a fluid opening 140-3 adjacent to chip mounting surface 140-2 that passes through the thickness of exterior wall 140-1. Ejection chip 118 is mounted, e.g., by an adhesive, to chip mounting surface 140-2 and is in fluid communication with fluid opening 140-3 (see FIG. 7) of exterior wall 140-1. Thus, the planar extent of ejection chip 118 is oriented along plane 142, with the plurality of ejection nozzles 120 oriented such that the fluid ejection direction 120-1 is substantially orthogonal to plane 142. Base wall 138 is oriented along a plane 146 (see FIGS. 6 and 7) that is substantially orthogonal to plane 142 of exterior wall 140-1.

Referring to FIGS. 7-10, body 122 of housing 112 also includes a chamber 148 located within a boundary defined by exterior perimeter wall 140. Chamber 148 forms a portion of fluid reservoir 136, and is configured to define an interior space, and in particular, includes base wall 138 and has an interior perimetrical wall 150 configured to have rounded corners, so as to promote fluid flow in chamber 148. Stir bar 132 is moveable laterally and longitudinally along base wall 138 within the confining limits defined by interior perimetrical wall 150 of fluid reservoir 136.

Interior perimetrical wall 150 of chamber 148 has an extent bounded by a proximal end 150-1 and a distal end 150-2. Proximal end 150-1 is contiguous with, and may form a transition radius with, base wall 138. Such an edge radius may help in mixing effectiveness by reducing the number of sharp corners. Distal end 150-2 is configured to define a perimetrical end surface 150-3 at an open end 148-1 of chamber 148. Perimetrical end surface 150-3 may include a plurality of perimetrical ribs, or undulations, to provide an effective sealing surface for engagement with diaphragm 130 (see FIG. 6). The extent of interior perimetrical wall 150 of chamber 148 is substantially orthogonal to base wall 138, and is substantially parallel to the corresponding extent of exterior perimeter wall 140 (see FIG. 7).

Figure 8:
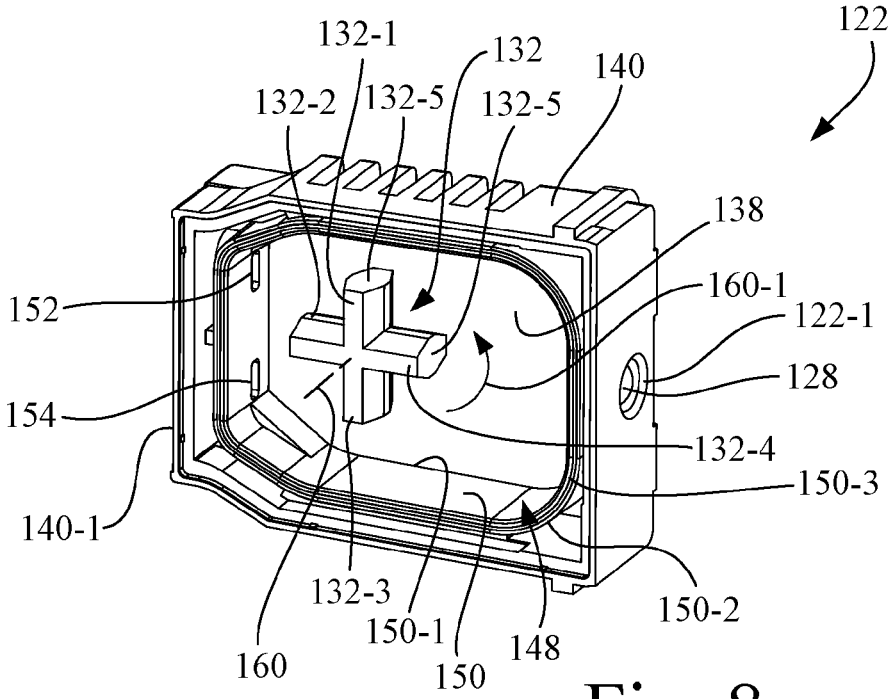
FIG. 8 is another perspective view of the depiction of FIG. 6, in an orientation to show the channel inlet and channel outlet of a fluid channel.

As best shown in FIG. 8, chamber 148 has an inlet fluid port 152 and an outlet fluid port 154, each of which is formed in a portion of interior perimetrical wall 150. The terms "inlet" and "outlet" are terms of convenience that are used in distinguishing between the multiple ports of the present embodiment, and are correlated with a particular rotational direction of stir bar 132. However, it is to be understood that it is the rotational direction of stir bar 132 that dictates whether a particular port functions as an inlet port or an outlet port, and it is within the scope of this invention to reverse the rotational direction of stir bar 132, and thus reverse the roles of the respective ports within chamber 148.

Figure 10:
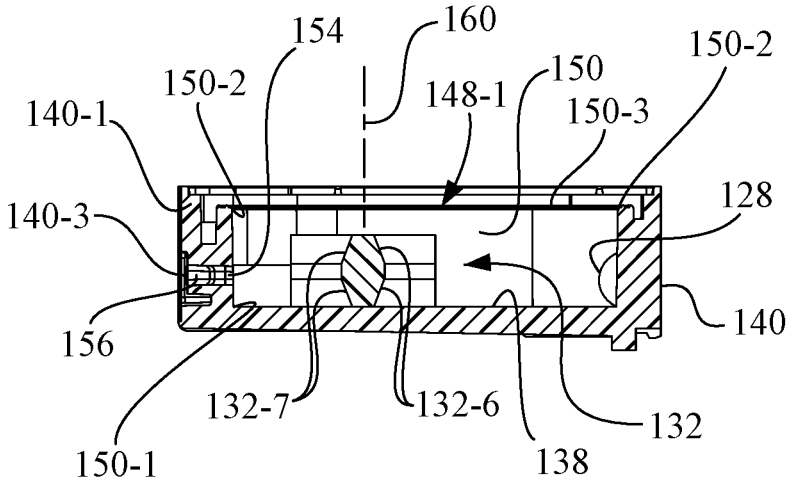
FIG. 10 is a section view of the body/stir bar arrangement of FIG. 9, taken along line 10-10 of FIG. 9.

Inlet fluid port 152 is separated a distance from outlet fluid port 154 along a portion of interior perimetrical wall 150. As best shown in FIG. 10, body 122 of housing 112 includes a fluid channel 156 interposed between the portion of interior perimetrical wall 150 of chamber 148 and exterior wall 140-1 of exterior perimeter wall 140 that carries ejection chip 118.

Fluid channel 156 is configured to minimize particulate settling in a region of ejection chip 118. Fluid channel 156 is sized, e.g., using empirical data, to provide a desired flow rate while also maintaining an acceptable fluid velocity for fluid mixing through fluid channel 156. In the present embodiment, fluid channel 156 is configured as a U-shaped elongated passage. Fluid channel 156 dimensions, e.g., height and width, and shape are selected to provide a desired combination of fluid flow and fluid velocity for facilitating intra-channel stirring. Fluid channel 156 is configured to connect inlet fluid port 152 of chamber 148 in fluid communication with outlet fluid port 154 of chamber 148, and also connects fluid opening 140-3 (see FIG. 7) of exterior wall 140-1 of exterior perimeter wall 140 in fluid communication with both inlet fluid port 152 and outlet fluid port 154 (see FIG. 8) of chamber 148.

Referring again to FIGS. 1, 6, and 7, diaphragm 130 is positioned between lid 124 and perimetrical end surface 150-3 of interior perimetrical wall 150 of chamber 148. The attachment of lid 124 to body 122 compresses a perimeter of diaphragm 130 thereby creating a continuous seal between diaphragm 130 and body 122. More particularly, diaphragm 130 is configured for sealing engagement with perimetrical end surface 150-3 of interior perimetrical wall 150 of chamber 148 in forming fluid reservoir 136. Thus, in combination, chamber 148 and diaphragm 130 cooperate to define fluid reservoir 136 having a variable volume.

Referring particularly to FIGS. 1 and 6, an exterior surface of diaphragm 130 is vented to the atmosphere through a vent hole 124-1 located in lid 124 so that a controlled negative pressure can be maintained in fluid reservoir 136. Diaphragm 130 is made of rubber, and includes a dome portion 130-1 configured to progressively collapse toward base wall 138 as fluid is depleted from microfluidic dispensing device 110, so as to maintain a desired negative pressure in chamber 148, and thus changing the effective volume of the variable volume of fluid reservoir 136, also referred to herein as a bulk region.

Referring to FIGS. 6-10, stir bar 132 moveably resides in, and is confined within, the variable volume of fluid reservoir 136 and chamber 148, and is located within a boundary defined by the interior perimetrical wall 150 of chamber 148. In the present embodiment, stir bar 132 has a rotational axis 160 and a plurality of paddles 132-1, 132-2, 132-3, 132-4 that radially extend away from the rotational axis 160. Stir bar 132 has a magnet 162 (see FIG. 9), e.g., a permanent magnet, configured for interaction with an external magnetic field generator 164 (see FIG. 1) to drive stir bar 132 to rotate around the rotational axis 160. The principle of stir bar 132 operation is that as magnet 162 is aligned to a strong enough external magnetic field generated by external magnetic field generator 164, then rotating the external magnetic field generated by external magnetic field generator 164 in a controlled manner will rotate stir bar 132. The external magnetic field generated by external magnetic field generator 164 may be rotated electronically, akin to operation of a stepper motor, or may be rotated via a rotating shaft. Thus, stir bar 132 is effective to provide fluid mixing in fluid reservoir 136 by the rotation of stir bar 132 around the rotational axis 160.

Fluid mixing in the bulk region relies on a flow velocity caused by rotation of stir bar 132 to create a shear stress at the settled boundary layer of the particulate. When the shear stress is greater than the critical shear stress (empirically determined) to start particle movement, remixing occurs because the settled particles are now distributed in the moving fluid. The shear stress is dependent on both the fluid parameters such as: viscosity, particle size, and density; and mechanical design factors such as: container shape, stir bar geometry, fluid thickness between moving and stationary surfaces, and rotational speed.

A fluid flow is generated by rotating stir bar 132 in a fluid region, e.g., fluid reservoir 136, and fluid channel 156 associated with ejection chip 118, so as to ensure that mixed bulk fluid is presented to ejection chip 118 for nozzle ejection and to move fluid adjacent to ejection chip 118 to the bulk region of fluid reservoir 136 to ensure that the channel fluid flowing through fluid channel 156 mixes with the bulk fluid of fluid reservoir 136, so as to produce a more uniform mixture. Although this flow is primarily distribution in nature, some mixing will occur if the flow velocity is sufficient to create a shear stress above the critical value.

Stir bar 132 primarily causes rotation flow of the fluid about a central region associated with the rotational axis 160 of stir bar 132, with some axial flow with a central return path as in a partial toroidal flow pattern. Advantageously, in the present embodiment, the rotational axis 160 of stir bar 132 is moveable within the confinement range defined by fluid reservoir 136.

Figure 9:
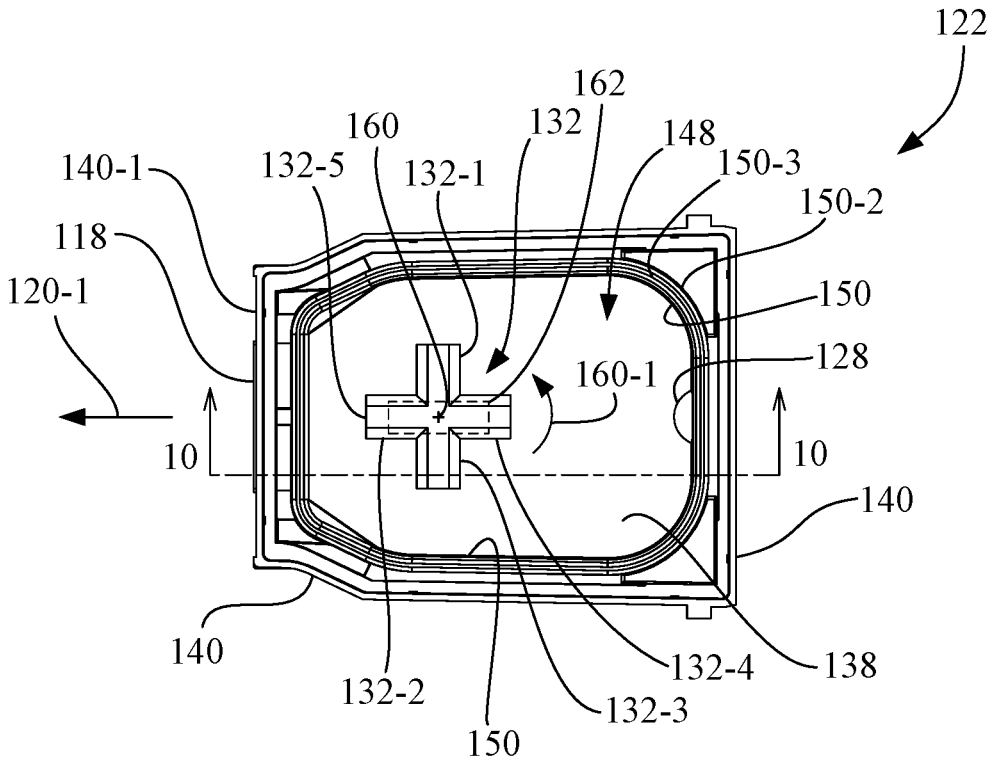
FIG. 9 is an orthogonal view of the body/stir bar arrangement of FIGS. 7 and 8, as viewed in a direction into the body of the chamber toward the base wall of the body.

Referring to FIGS. 7-10, each paddle of the plurality of paddles 132-1, 132-2, 132-3, 132-4 of stir bar 132 has a respective free end tip 132-5. Referring to FIGS. 8-10, so as to reduce rotational drag, each paddle may include upper and lower symmetrical pairs of chamfered surfaces, forming leading beveled surfaces 132-6 and trailing beveled surfaces 132-7 relative to a rotational direction 160-1 of stir bar 132. It is also contemplated that each of the plurality of paddles 132-1, 132-2, 132-3, 132-4 of stir bar 132 may have a pill or cylindrical shape. In the present embodiment, stir bar 132 has two pairs of diametrically opposed paddles, wherein a first paddle of the diametrically opposed paddles has a first free end tip 132-5 and a second paddle of the diametrically opposed paddles has a second free end tip 132-5.

In the present embodiment, the four paddles forming the two pairs of diametrically opposed paddles are equally spaced at 90 degree increments around the rotational axis 160. However, the actual number of paddles of stir bar 132 may be two or more, and preferably three or four, but more preferably four, with each adjacent pair of paddles having the same angular spacing around the rotational axis 160. For example, a stir bar 132 configuration having three paddles may have a paddle spacing of 120 degrees, having four paddles may have a paddle spacing of 90 degrees, etc.

Referring to FIGS. 6-10, stir bar 132 is located for movement within the variable volume of fluid reservoir 136 (see FIG. 6), and more particularly, within the boundary defined by interior perimetrical wall 150 of chamber 148 (see FIGS. 7-10).

As such, in the present embodiment, stir bar 132 is confined within fluid reservoir 136 by the confining surfaces provided by fluid reservoir 136, e.g., by chamber 148 and diaphragm 130. The extent to which stir bar 132 is movable within fluid reservoir 136 is determined by the radial tolerances provided between stir bar 132 and interior perimetrical wall 150 of chamber 148 in the radial (lateral/longitudinal) direction, and by the axial tolerances between stir bar 132 and the axial limit provided by the combination of base wall 138 of chamber 148 and diaphragm 130.

Thus, referring to FIGS. 7-10, the rotational axis 160 of stir bar 132 is free to move radially and axially, e.g., longitudinally, laterally, and/or vertically, within fluid reservoir 136 to the extent permitted by the confining surfaces, e.g., interior surfaces of chamber 148 and diaphragm 130, of fluid reservoir 136. Such confining surfaces also limit the canting of the rotational axis 160 of stir bar 132 to be within a predefined angular range, e.g., perpendicular, plus or minus 45 degrees, relative to plane 146 of base wall 138 of chamber 148 and/or to the fluid ejection direction 120-1. Stated differently, the rotational axis 160 of stir bar 132 is moveable radially and axially within fluid reservoir 136, and may be canted in an angular range of perpendicular, plus or minus 45 degrees, relative to plane 146 of base wall 138 of chamber 148 and/or to the fluid ejection direction 120-1.

In the present embodiment, referring to FIGS. 6-10, stir bar 132 is moveably confined within fluid reservoir 136, and the confining surfaces of fluid reservoir 136 maintain an orientation of stir bar 132 such that the free end tip 132-5 of a respective paddle of the plurality of paddles 132-1, 132-2, 132-3, 132-4 periodically face fluid channel 156, and in turn, intermittently face toward fluid opening 140-3 that is in fluid communication with ejection chip 118, as stir bar 132 is rotated about the rotational axis 160, and permits movement of stir bar 132 toward or away from inlet and outlet fluid ports 152, 154; fluid channel 156; fluid opening 140-3; and ejection chip 118.

In accordance with the present invention, to effect movement of the location of stir bar 132 within fluid reservoir 136, first, external magnetic field generator 164 (see FIG. 1) is energized to interact with magnet 162 (see FIG. 9), e.g., a permanent magnet, of stir bar 132. If the magnetic field generated by external magnetic field generator 164 is rotating, then stir bar 132 will tend to rotate in unison with the rotation of the magnetic field. Next, housing 112 of microfluidic dispensing device 110 is moved relative to external magnetic field generator 164, or vice versa. In other words, magnet 162 of stir bar 132 is attracted to the magnetic field generated by external magnetic field generator 164, such that the rotational axis 160 of stir bar 132 will be relocated within fluid reservoir 136 with a change of location of external magnetic field generator 164 relative to the location of housing 112 of microfluidic dispensing device 110.

It is contemplated that the movement pattern of the rotational axis 160 of stir bar 132 may be linear, e.g., longitudinal, lateral, diagonal, X-shaped, Z-shaped, etc., or may be non-linear, such as curved, circular, elliptical, a FIG. 8 pattern, etc.

FIGS. 11-21 depict another embodiment of the invention, which in the present example is in the form of a microfluidic dispensing device 210. Elements common to both microfluidic dispensing device 110 and microfluidic dispensing device 210 are identified using common element numbers, and for brevity, are not described again below in full detail.

Microfluidic dispensing device 210 generally includes a housing 212 and TAB circuit 114, with microfluidic dispensing device 210 configured to contain a supply of a fluid, such as a particulate carrying fluid, and with TAB circuit 114 configured to facilitate the ejection of the fluid from housing 212.

Figure 11:
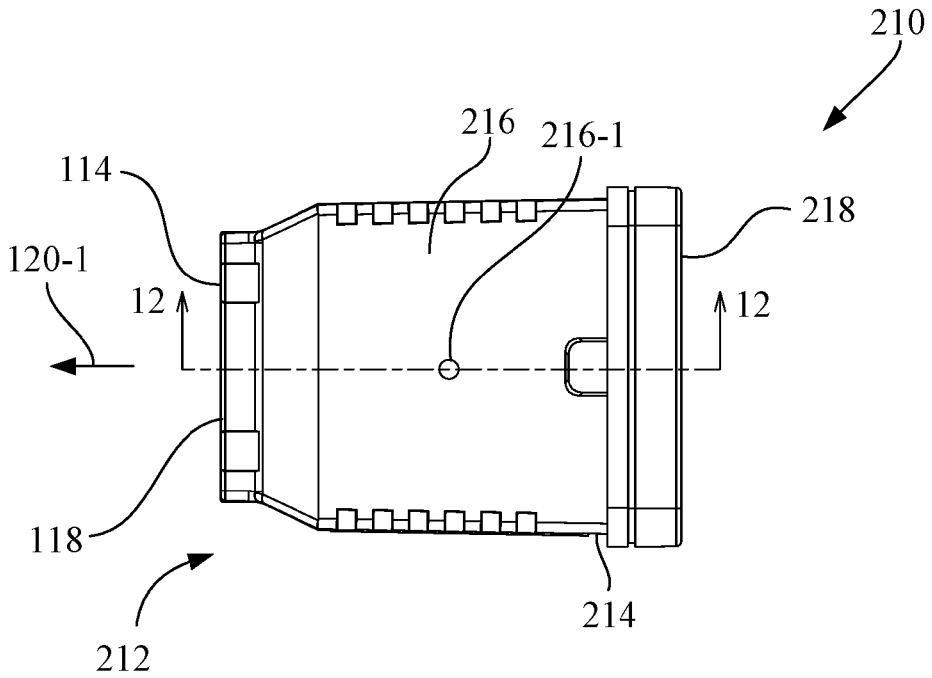
FIG. 11 is a top view of another embodiment of a microfluidic dispensing device in accordance with the present invention.
Figure 12:
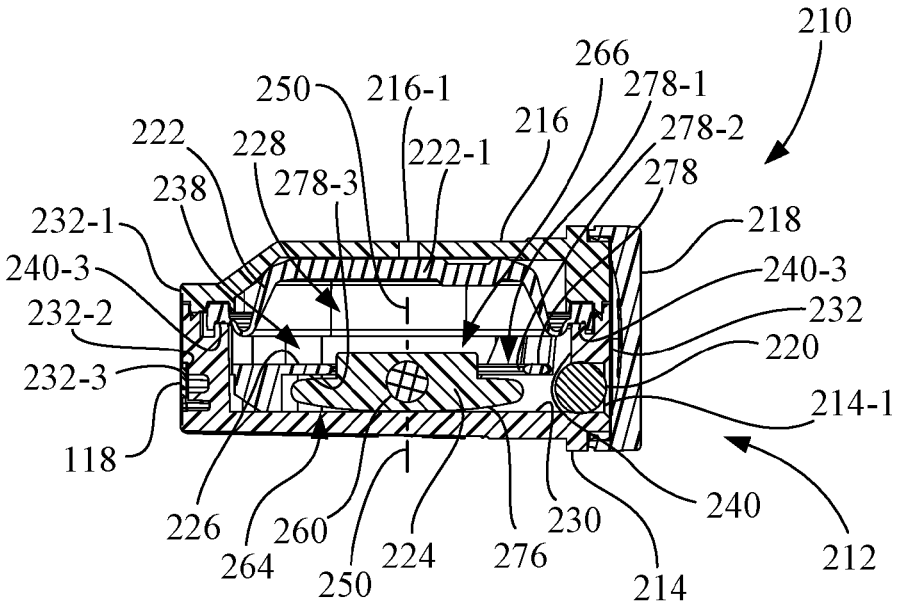
FIG. 12 is a section view of the microfluidic dispensing device of FIG. 11, taken along line 12-12 of FIG. 11.
Figure 13:
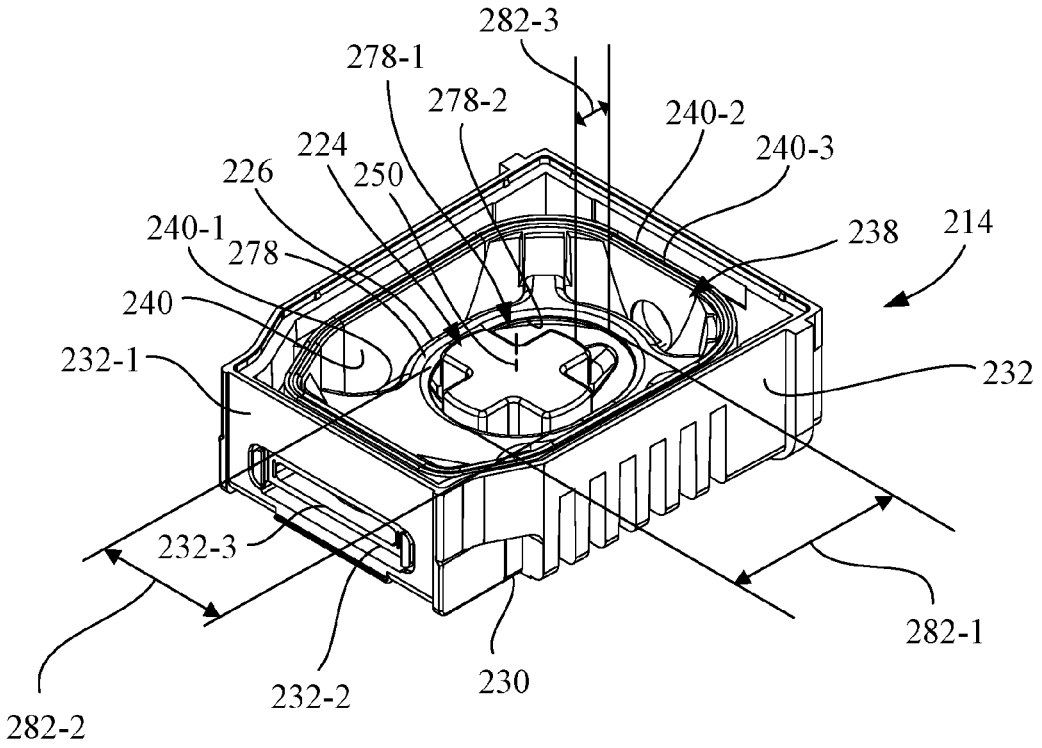
FIG. 13 is another perspective view of the microfluidic dispensing device of FIG. 11, with the end cap, lid and diaphragm removed to illustrate a range of motion of the moveable stir bar with respect to the guide portion.

As best shown in FIGS. 11-13, housing 212 includes a body 214, a lid 216, an end cap 218, and a fill plug 220 (e.g., ball). Contained within housing 212 is a diaphragm 222, a stir bar 224, and a guide portion 226. Each of housing 212 components, stir bar 224, and guide portion 226 may be made of plastic, using a molding process. Diaphragm 222 is made of rubber, using a molding process. Also, in the present embodiment, fill plug 220 may be in the form of a stainless steel ball bearing.

Referring to FIG. 12, in general, a fluid (not shown) is loaded through a fill hole 214-1 in body 214 into a sealed region, i.e., a fluid reservoir 228, between body 214 and diaphragm 222. Back pressure in fluid reservoir 228 is set and then maintained by inserting, e.g., pressing, fill plug 220 into fill hole 214-1 to prevent air from leaking into fluid reservoir 228 or fluid from leaking out of fluid reservoir 228. End cap 218 is then placed onto an end of the body 214/lid 216 combination, opposite to ejection chip 118. Stir bar 224 resides in the sealed fluid reservoir 228 between body 214 and diaphragm 222 that contains the fluid. An internal fluid flow may be generated within fluid reservoir 228 by rotating stir bar 224 so as to provide fluid mixing and redistribution of particulate within the sealed region of fluid reservoir 228.

Figure 14:
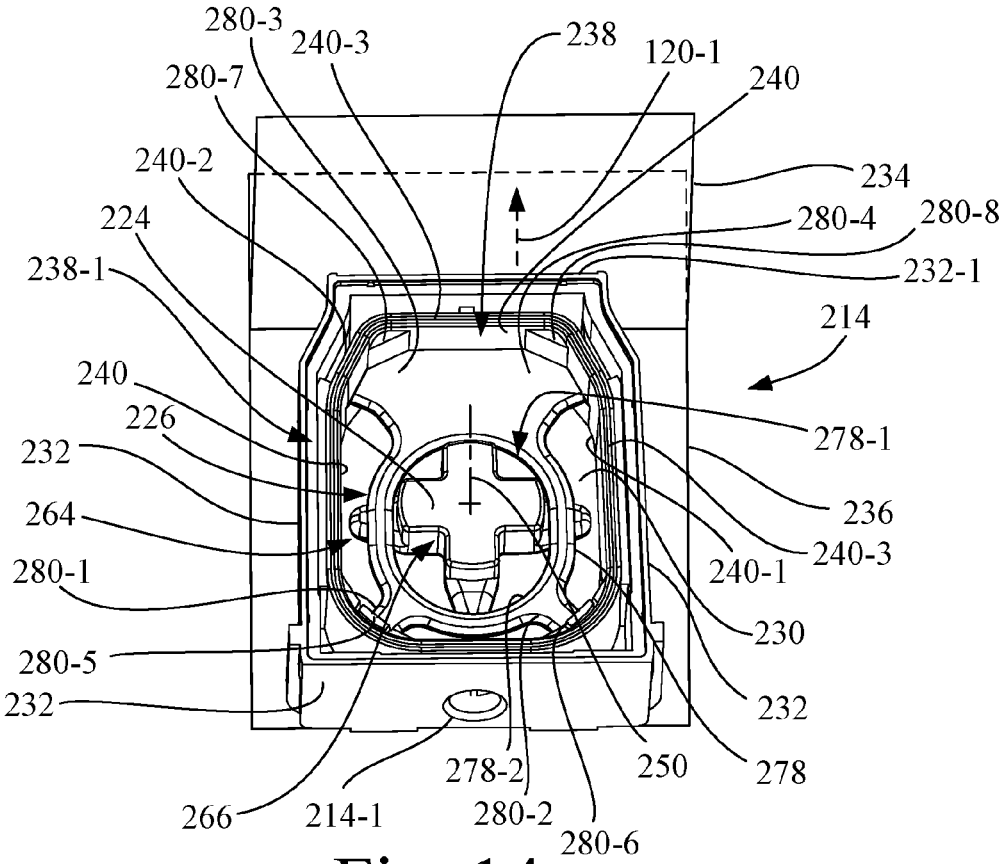
FIG. 14 is another perspective view of the microfluidic dispensing device of FIG. 11, with the end cap, lid and diaphragm removed to expose the guide portion and the moveable stir bar contained in the body, shown in relation to first and second planes and the fluid ejection direction.
Figure 15:
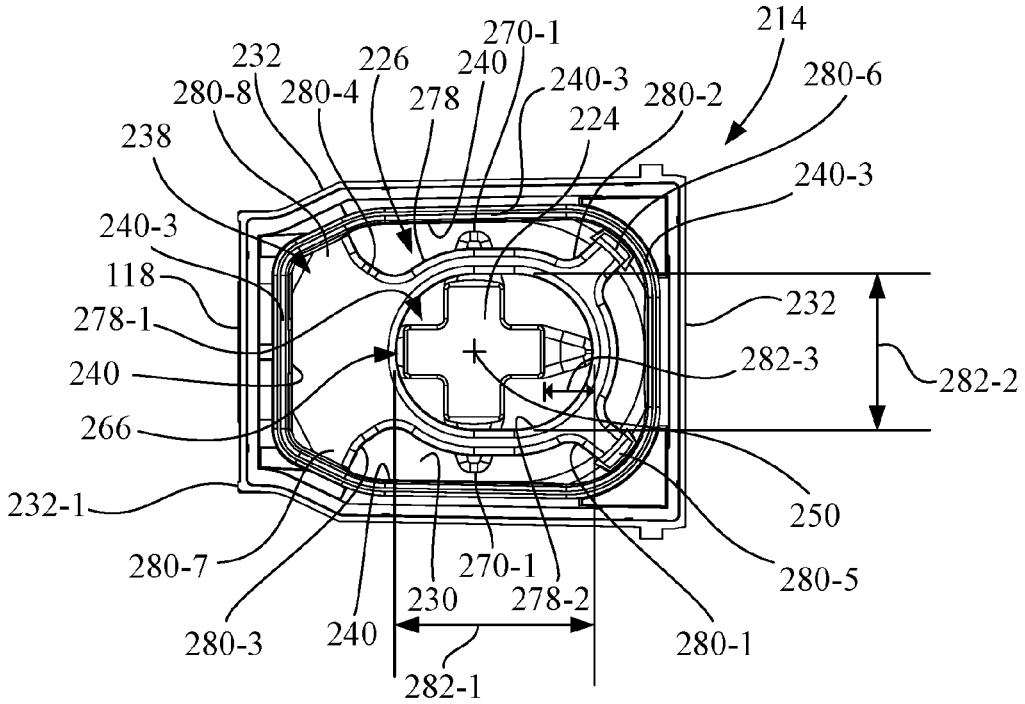
FIG. 15 is an orthogonal top view corresponding to the perspective view of FIG. 14, showing the body having a chamber that contains the guide portion and the moveable stir bar, and illustrating the range of motion of the moveable stir bar with respect to the guide portion.

Referring now also to FIGS. 14 and 15, body 214 of housing 212 has a base wall 230 and an exterior perimeter wall 232 contiguous with base wall 230. Exterior perimeter wall 232 is oriented to extend from base wall 230 in a direction that is substantially orthogonal to base wall 230. Referring also to FIGS. 12 and 13, lid 216 is configured to engage exterior perimeter wall 232. Thus, exterior perimeter wall 232 is interposed between base wall 230 and lid 216, with lid 216 being attached to the open free end of exterior perimeter wall 232 by weld, adhesive, or other fastening mechanism, such as a snap fit or threaded union.

Referring to FIGS. 12-15, exterior perimeter wall 232 of body 214 includes an exterior wall 232-1, which is a contiguous portion of exterior perimeter wall 232. Exterior wall 232-1 has a chip mounting surface 232-2 and a fluid opening 232-3 adjacent to chip mounting surface 232-2 that passes through the thickness of exterior wall 232-1.

Referring to FIGS. 13-15, chip mounting surface 232-2 defines a plane 234. Ejection chip 118 is mounted, e.g., via an adhesive, to chip mounting surface 232-2 and is in fluid communication with fluid opening 232-3 of exterior wall 232-1. The planar extent of ejection chip 118 is oriented along the plane 234, with the plurality of ejection nozzles 120 (see e.g., FIG. 1) oriented such that the fluid ejection direction 120-1 is substantially orthogonal to the plane 234. Base wall 230 is oriented along a plane 236 that is substantially orthogonal to the plane 234 of exterior wall 232-1, and is substantially parallel to the fluid ejection direction 120-1 (see FIGS. 11 and 14).

As illustrated in FIGS. 12-15, body 214 of housing 212 includes a chamber 238 located within a boundary defined by exterior perimeter wall 232. Chamber 238 forms a portion of fluid reservoir 228, and is configured to define an interior space, and in particular, includes base wall 230 and has an interior perimetrical wall 240 configured to have rounded corners, so as to promote fluid flow in chamber 238. Stir bar 224 is laterally and longitudinally located by guide portion 226 within fluid reservoir 228 and within a boundary defined by interior perimetrical wall 240, wherein guide portion 226 facilitates movement of stir bar 224 in at least one direction substantially perpendicular to the rotational axis 250 of stir bar 224.

Referring to FIGS. 13-15, interior perimetrical wall 240 of chamber 238 has an extent bounded by a proximal end 240-1 and a distal end 240-2. Proximal end 240-1 is contiguous with, and preferably forms a transition radius with, base wall 230. Distal end 240-2 is configured to define a perimetrical end surface 240-3 at an open end 238-1 of chamber 238. Perimetrical end surface 240-3 may include a plurality of ribs, or undulations, to provide an effective sealing surface for engagement with diaphragm 222. The extent of interior perimetrical wall 240 of chamber 238 is substantially orthogonal to base wall 230, and is substantially parallel to the corresponding extent of exterior perimeter wall 232.

Figure 17:
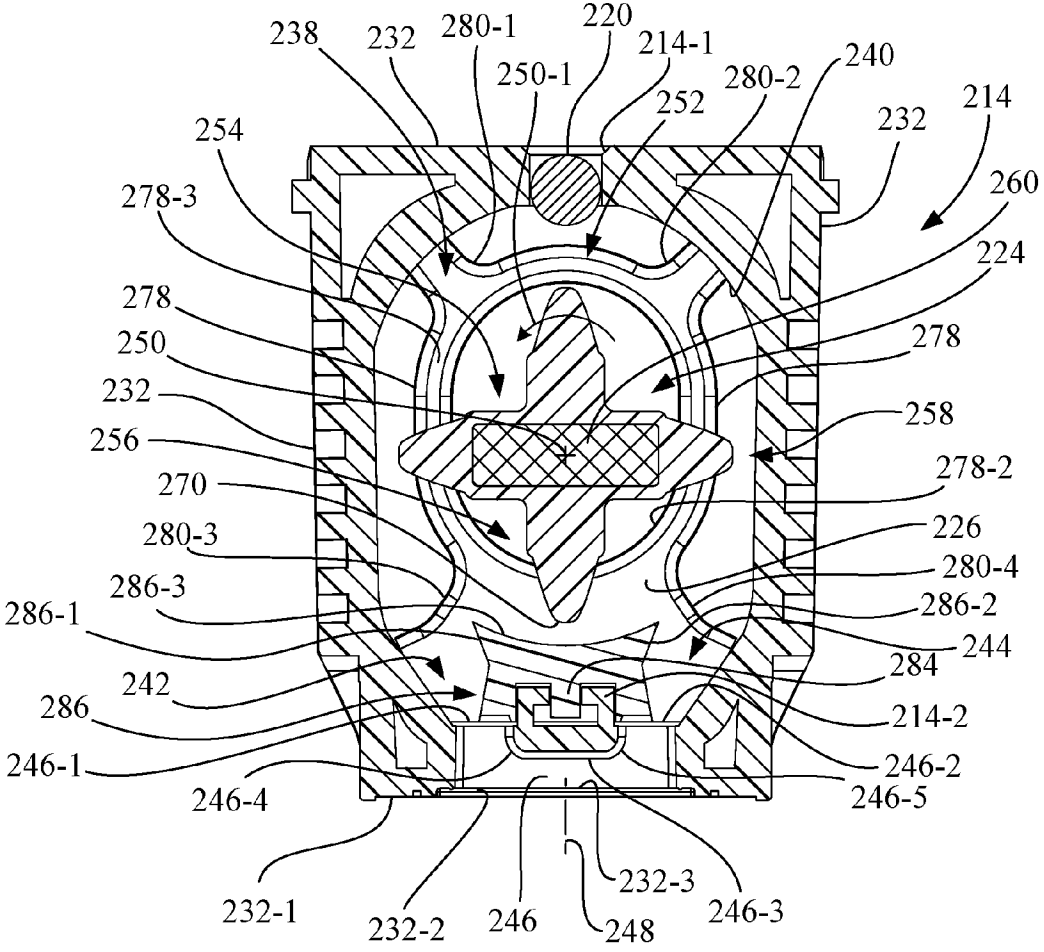
FIG. 17 is a section view taken along line 17-17 of FIG. 16.
Figure 16:
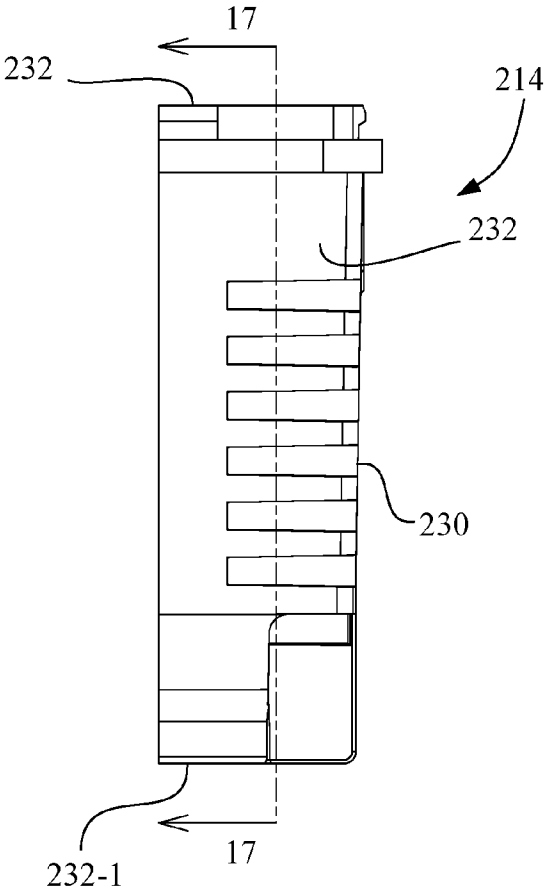
FIG. 16 is a side orthogonal view of the body of the microfluidic dispensing device of FIG. 11, wherein the body contains the guide portion and the moveable stir bar.
Figure 18:
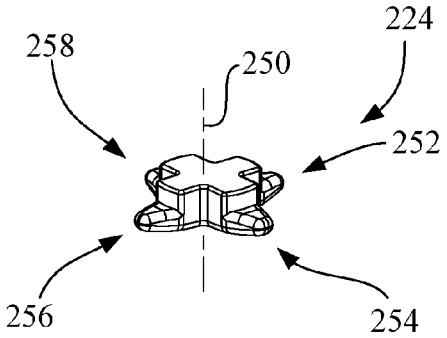
FIG. 18 is a perspective view of an embodiment of the stir bar of the microfluidic dispensing device of FIG. 11, as further depicted in FIGS. 12-15 and 17.

Referring to FIGS. 16 and 17, chamber 238 has an inlet fluid port 242 and an outlet fluid port 244, each of which is formed in a portion of interior perimetrical wall 240. Inlet fluid port 242 is separated a distance from outlet fluid port 244 along the portion of interior perimetrical wall 240. The terms "inlet" and "outlet" are terms of convenience that are used in distinguishing between the multiple ports of the present embodiment, and are correlated with a particular rotational direction 250-1 of stir bar 224. However, it is to be understood that it is the rotational direction of stir bar 224 that dictates whether a particular port functions as an inlet port or an outlet port, and it is within the scope of this invention to reverse the rotational direction of stir bar 224, and thus reverse the roles of the respective ports within chamber 238.

As best shown in FIG. 17, body 214 of housing 212 includes a fluid channel 246 interposed between a portion of interior perimetrical wall 240 of chamber 238 and exterior wall 232-1 of exterior perimeter wall 232 that carries ejection chip 118. Fluid channel 246 is configured to minimize particulate settling in a region of fluid opening 232-3, and in turn, ejection chip 118.

In the present embodiment, fluid channel 246 is configured as a U-shaped elongated passage having a channel inlet 246-1 and a channel outlet 246-2. Fluid channel 246 dimensions, e.g., height and width, and shape are selected to provide a desired combination of fluid flow and fluid velocity for facilitating intra-channel stirring.

Fluid channel 246 is configured to connect inlet fluid port 242 of chamber 238 in fluid communication with outlet fluid port 244 of chamber 238, and also connects fluid opening 232-3 of exterior wall 232-1 of exterior perimeter wall 232 in fluid communication with both inlet fluid port 242 and outlet fluid port 244 of chamber 238. In particular, channel inlet 246-1 of fluid channel 246 is located adjacent to inlet fluid port 242 of chamber 238 and channel outlet 246-2 of fluid channel 246 is located adjacent to outlet fluid port 244 of chamber 238. In the present embodiment, the structure of inlet fluid port 242 and outlet fluid port 244 of chamber 238 is symmetrical. Each of inlet fluid port 242 and outlet fluid port 244 of chamber 238 may have a beveled ramp structure configured such that each of inlet fluid port 242 and outlet fluid port 244 converges in a respective direction toward fluid channel 246.

Fluid channel 246 has a convexly arcuate wall 246-3 that is positioned between channel inlet 246-1 and channel outlet 246-2, with fluid channel 246 being symmetrical about a channel mid-point 248. In turn, convexly arcuate wall 246-3 of fluid channel 246 is positioned between inlet fluid port 242 and outlet fluid port 244 of chamber 238 on the opposite side of interior perimetrical wall 240 from the interior space of chamber 238, with convexly arcuate wall 246-3 positioned to face fluid opening 232-3 of exterior wall 232-1 and fluid ejection chip 118.

Convexly arcuate wall 246-3 is configured to create a fluid flow substantially parallel to ejection chip 118. In the present embodiment, a longitudinal extent of convexly arcuate wall 246-3 has a radius that faces fluid opening 232-3, is substantially parallel to ejection chip 118, and has transition radii 246-4, 246-5 located adjacent to channel inlet 246-1 and channel outlet 246-2 surfaces, respectively. The radius and radii of convexly arcuate wall 246-3 help with fluid flow efficiency. A distance between convexly arcuate wall 246-3 and fluid ejection chip 118 is narrowest at the channel mid-point 248, which coincides with a mid-point of the longitudinal extent of fluid ejection chip 118, and in turn, with at a mid-point of the longitudinal extent of fluid opening 232-3 of exterior wall 232-1.

Referring again to FIG. 12, diaphragm 222 is positioned between lid 216 and perimetrical end surface 240-3 of interior perimetrical wall 240 of chamber 238. The attachment of lid 216 to body 214 compresses a perimeter of diaphragm 222 thereby creating a continuous seal between diaphragm 222 and body 214, and more particularly, diaphragm 222 is configured for sealing engagement with perimetrical end surface 240-3 of interior perimetrical wall 240 of chamber 238 in forming fluid reservoir 228. Thus, in combination, chamber 238 and diaphragm 222 cooperate to define fluid reservoir 228 having a variable volume.

An exterior surface of diaphragm 222 is vented to the atmosphere through a vent hole 216-1 located in lid 216 so that a controlled negative pressure can be maintained in fluid reservoir 228. Diaphragm 222 is made of rubber, and includes a dome portion 222-1 configured to progressively collapse toward base wall 230 as fluid is depleted from microfluidic dispensing device 210, so as to maintain a desired negative pressure in chamber 238, and thus changing the effective volume of the variable volume of fluid reservoir 228.

Referring to FIG. 12, stir bar 224 resides, and is confined within, in the variable volume of fluid reservoir 228 and in chamber 238, and is located within a boundary defined by interior perimetrical wall 240 of chamber 238. Referring also to FIGS. 13-15 and 17-21, stir bar 224 has a rotational axis 250 and a plurality of paddles 252, 254, 256, 258 that radially extend away from the rotational axis 250. Stir bar 224 has a magnet 260 (see FIGS. 12, 17, and 21), e.g., a permanent magnet, configured for interaction with external magnetic field generator 164 (see FIG. 1) to drive stir bar 224 to rotate around the rotational axis 250. In the present embodiment, stir bar 224 has two pairs of diametrically opposed paddles that are equally spaced at 90 degree increments around rotational axis 250. However, the actual number of paddles of stir bar 224 is two or more, and preferably three or four, but more preferably four, with each adjacent pair of paddles having the same angular spacing around the rotational axis 250. For example, a stir bar 224 configuration having three paddles would have a paddle spacing of 120 degrees, having four paddles would have a paddle spacing of 90 degrees, etc.

Figure 19:
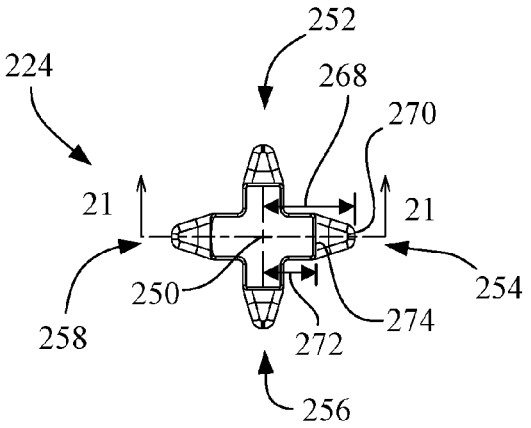
FIG. 19 is a top view of the stir bar of FIG. 18.

In the present embodiment, as shown in FIGS. 12-15 and 18-21, stir bar 224 is configured in a stepped, i.e., two-tiered, cross pattern with chamfered surfaces which may provide the following desired attributes: quiet, short, low axial drag, good rotational speed transfer, and capable of starting to mix with stir bar 224 in particulate sediment. In particular, referring to FIG. 20, each of the plurality of paddles 252, 254, 256, 258 of stir bar 224 has an axial extent 262 having a first tier portion 264 and a second tier portion 266. Referring also to FIG. 19, first tier portion 264 has a first radial extent 268 terminating at a first distal end tip 270. Second tier portion 266 has a second radial extent 272 terminating in a second distal end tip 274. The first radial extent 268 is greater than the second radial extent 272, such that a first rotational velocity of first distal end tip 270 of first tier portion 264 is higher than a second rotational velocity of second distal end tip 274 of second tier portion 266, while the angular velocity of first distal end tip 270 of first tier portion 264 is the same as the angular velocity of second distal end tip 274 of second tier portion 266.

First tier portion 264 has a first tip portion 270-1 that includes first distal end tip 270. First tip portion 270-1 may be tapered in a direction from the rotational axis 250 toward first distal end tip 270. First tip portion of 270-1 of first tier portion 264 has symmetrical upper and lower surfaces, each having a beveled, i.e., chamfered, leading surface and a beveled trailing surface. The beveled leading surfaces and the beveled trailing surfaces of first tip portion 270-1 are configured to converge at first distal end tip 270.

Figure 20:
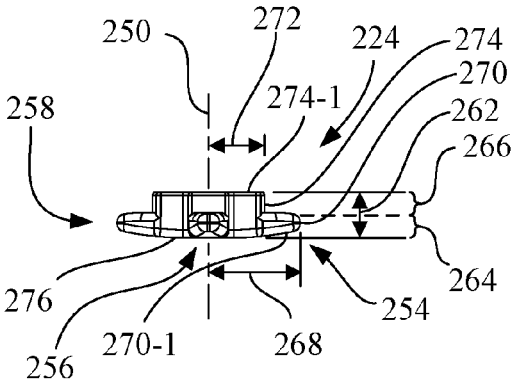
FIG. 20 is a side view of the stir bar of FIG. 18.
Figure 21:
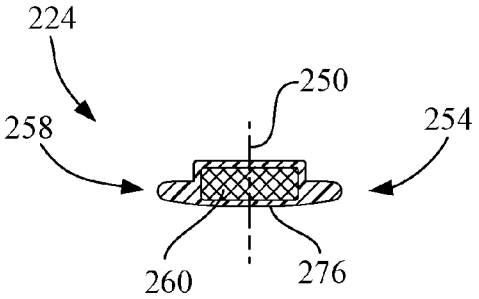
FIG. 21 is a section view of the stir bar of FIG. 18 taken along line 21-21 of FIG. 19.

Also, in the present embodiment, first tier portion 264 of each of the plurality of paddles 252, 254, 256, 258 collectively form a convex surface 276 (see FIGS. 12, 20 and 21). As shown in FIG. 12, convex surface 276 has a drag-reducing radius positioned to contact base wall 230 of chamber 238. The drag-reducing radius may be, for example, at least three times greater than the first radial extent 268 of first tier portion 264 of each of the plurality of paddles 252, 254, 256, 258.

Referring again to FIG. 20, second tier portion 266 has a second tip portion 274-1 that includes second distal end tip 274. Second distal end tip 274 may have a radial blunt end surface. Second tier portion 266 of each of the plurality of paddles 252, 254, 256, 258 has an upper surface having a beveled, i.e., chamfered, leading surface and a beveled trailing surface.

Referring to FIGS. 12-15, the orientation of stir bar 224 is achieved by guide portion 226, with guide portion 226 also being located within chamber 238 in the variable volume of fluid reservoir 228, and more particularly, within the boundary defined by interior perimetrical wall 240 of chamber 238. Guide portion 226 is configured to confine and position stir bar 224 for movement in a predetermined portion of the interior space of chamber 238.

Referring to FIGS. 12-15 and 17, guide portion 226 includes a confining member 278, and a plurality of mounting arms 280-1, 280-2, 280-3, 280-4 coupled to confining member 278. Confining member 278 has a guide opening 278-1, which in the present embodiment is in the form of an elongated opening 278-1, that defines an interior radial confining surface 278-2 that limits, yet facilitates, radial movement of stir bar 224 in a direction substantially perpendicular to rotational axis 250. While in the present embodiment the longitudinal extent of elongated opening 278-1 is linear, those skilled in the art will recognize that the longitudinal extent of elongated opening 278-1 may have other non-linear shapes, such as S-shaped or C-shaped.

Referring particularly to FIGS. 13 and 15, elongated opening 278-1 has a longitudinal extent 282-1 and a lateral extent 282-2 perpendicular to longitudinal extent 282-1. Longitudinal extent 282-1 is greater, i.e., longer, than lateral extent 282-2. In the present embodiment, longitudinal extent 282-1 is in a direction toward inlet and outlet fluid ports 242, 244; fluid channel 246; and fluid opening 232-3 of exterior wall 232-1 of body 214 of housing 212, so as to facilitate movement of stir bar 224 toward or away from inlet and outlet fluid ports 242, 244; fluid channel 246; fluid opening 232-3; and ejection chip 118.

In particular, second tier portion 266 of stir bar 224 is received in elongated opening 278-1 of confining member 278. Interior radial confining surface 278-2 of elongated opening 278-1 is configured to contact the radial extent of second tier portion 266 of the plurality of paddles 252, 254, 256, 258 of stir bar 224 to limit, yet facilitate, radial (e.g., lateral and/or longitudinal) movement of stir bar 224 relative to rotational axis 250 of stir bar 224. A maximum distance 282-3 between stir bar 224 and interior radial confining surface 278-2 along the longitudinal extent 282-1 of elongated opening 278-1 defines the longitudinal limit of motion of stir bar 224 within chamber 238.

In the present example, the lateral extent 282-2 of interior radial confining surface 278-2 of elongated opening 278-1 is only slightly larger (e.g., 0.5 to 5 percent) than the diameter across the radial extent of second tier portion 266 of stir bar 224, whereas the longitudinal extent 282-1 of interior radial confining surface 278-2 of elongated opening 278-1 is substantially larger (e.g., greater than 10 percent) than the diameter across the radial extent of second tier portion 266 of stir bar 224, so as to facilitate radial movement of stir bar 224 in a direction substantially perpendicular to rotational axis 250 of stir bar 224 along the longitudinal extent 282-1 of interior radial confining surface 278-2 of elongated opening 278-1. In other words, in the present example, stir bar 224 is permitted to slide back and forth along the longitudinal extent 282-1 of interior radial confining surface 278-2 of elongated opening 278-1.

Referring to FIGS. 12 and 17, confining member 278 has an axial confining surface 278-3 positioned to be axially offset from base wall 230 of chamber 238, for axial engagement with first tier portion 264 of stir bar 224.

Referring to FIGS. 14-17, the plurality of mounting arms 280-1, 280-2, 280-3, 280-4 are configured to engage body 214 of housing 212 to position, e.g., suspend, confining member 278 in the interior space of chamber 238, separated from base wall 230 of chamber 238, with axial confining surface 278-3 positioned to face, and to be axially offset from, base wall 230 of chamber 238. A distal end of each of mounting arms 280-1, 280-2, 280-3, 280-4 includes respective locating features 280-5, 280-6, 280-7, 280-8 that have free ends to engage a perimetrical portion of diaphragm 222 (see also FIG. 12).

In the present embodiment, referring to FIGS. 12 and 17, base wall 230 limits axial movement of stir bar 224 relative to the rotational axis 250 in a first axial direction and axial confining surface 278-3 of confining member 278 is located to axially engage at least a portion of first tier portion 264 of the plurality of paddles 252, 254, 256, 258 to limit axial movement of stir bar 224 relative to the rotational axis 250 in a second axial direction opposite to the first axial direction.

As such, in the present embodiment, stir bar 224 is radially confined within the region defined by interior radial confining surface 278-2 of elongated opening 278-1 of confining member 278, and is axially confined between axial confining surface 278-3 of confining member 278 and base wall 230 of chamber 238. The portion of chamber 238 and fluid reservoir 228 in which stir bar 224 is moveable is determined by the location of elongated opening 278-1 of guide portion 226 in chamber 238. The extent to which stir bar 224 is moveable within chamber 238 and fluid reservoir 228 is determined by the radial tolerances provided between interior radial confining surface 278-2 of elongated opening 278-1 of guide portion 226 and stir bar 224 in a radial direction perpendicular to rotational axis 250, and by the axial tolerances between stir bar 224 and the axial limit provided by the combination of base wall 230 and axial confining surface 278-3 of confining member 278. For example, the tighter the radial and axial tolerances provided by guide portion 226, the less variation of the rotational axis 250 of stir bar 224 from perpendicular relative to base wall 230, and the less side-to-side motion of stir bar 224 within fluid reservoir 228.

Notwithstanding, the longitudinal extent 282-1 of elongated opening 278-1 of confining member 278 facilitates radial movement of stir bar 224 in a direction substantially perpendicular to rotational axis 250 of stir bar 224 in at least one direction, e.g., in at least a longitudinal direction corresponding to the longitudinal extent 282-1 of elongated opening 278-1. Referring to FIGS. 13 and 15, a maximum distance 282-3 between stir bar 224 and interior radial confining surface 278-2 along the longitudinal extent 282-1 of elongated opening 278-1 defines the longitudinal limit of motion of stir bar 224 within chamber 238.

In view of the above, those skilled in the art will recognize that lateral motion of stir bar 224 may be facilitated by increasing lateral extent 282-2 of elongated opening 278-1 of guide portion 226, such that a gap is present between stir bar 224 and interior radial confining surface 278-2 along the lateral extent 282-2 of elongated opening 278-1 of confining member 278 of guide portion 226. As such, in addition to linear movement of rotational axis 250 of stir bar 224 being facilitated, other movement patterns, such as other linear patterns, e.g., diagonal, X-shaped, Z-shaped, etc., or non-linear, such as curved, circular, elliptical, a FIG. 8 pattern, etc., may be realized.

In accordance with the present invention, to effect movement of the location of stir bar 224 within fluid reservoir 228, first, external magnetic field generator 164 (see FIG. 1) is energized to interact with magnet 260 (see FIGS. 12 and 17), e.g., a permanent magnet, of stir bar 224. If the magnetic field generated by external magnetic field generator 164 is rotating, then stir bar 224 will tend to rotate in unison with the rotation of the magnetic field. Next, housing 212 of microfluidic dispensing device 210 is moved relative to external magnetic field generator 164, or vice versa. In other words, magnet 260 of stir bar 224 is attracted to the magnetic field generated by external magnetic field generator 164, such that the rotational axis 250 of stir bar 224 will be relocated within fluid reservoir 228 with a change of location of external magnetic field generator 164 relative to the location of housing 212 of microfluidic dispensing device 210.

In the present embodiment, guide portion 226 is configured as a unitary insert member that is removably received in housing 212. Referring to FIG. 17, guide portion 226 includes a first retention feature 284 and body 214 of housing 212 includes a second retention feature 214-2. First retention feature 284 is engaged with second retention feature 214-2 to attach guide portion 226 to body 214 of housing 212 in a fixed relationship with housing 212. First retention feature 284/second retention feature 214-2 combination may be, for example, in the form of a tab/slot arrangement, or alternatively, a slot/tab arrangement, respectively.

Referring to FIG. 17, guide portion 226 may further include a flow control portion 286 having a flow separator feature 286-1, a flow rejoining feature 286-2, and a concavely arcuate surface 286-3. Flow control portion 286 provides an axial spacing between axial confining surface 278-3 and base wall 230 in the region of inlet fluid port 242 and outlet fluid port 244. Concavely arcuate surface 286-3 is coextensive with, and extends between, each of flow separator feature 286-1 and flow rejoining feature 286-2. Flow separator feature 286-1 is positioned adjacent inlet fluid port 242 and flow rejoining feature 286-2 is positioned adjacent outlet fluid port 244. Flow separator feature 286-1 has a beveled wall that cooperates with inlet fluid port 242 of chamber 238 to guide fluid toward channel inlet 246-1 of fluid channel 246. Likewise, flow rejoining feature 286-2 has a beveled wall that cooperates with outlet fluid port 244 to guide fluid away from channel outlet 246-2 of fluid channel 246.

It is contemplated that all, or a portion, of flow control portion 286 may be incorporated into interior perimetrical wall 240 of chamber 238 of body 214 of housing 212.

In the present embodiment, as is best shown in FIG. 17, stir bar 224 is oriented such that the free ends of the plurality of paddles 252, 254, 256, 258 periodically face concavely arcuate surface 286-3 of flow control portion 286 as stir bar 224 is rotated about the rotational axis 250. More particularly, guide portion 226 is configured to confine stir bar 224 in a predetermined portion of the interior space of chamber 238. In the present example, elongated opening 278-1 of confining member 278 of guide portion 226 facilitates radial movement of stir bar 224 in a direction toward, or away from, concavely arcuate surface 286-3 of flow control portion 286 and toward, or away from, inlet and outlet fluid ports 242, 244; fluid channel 246; and fluid opening 232-3 in at least a longitudinal direction corresponding to the longitudinal extent 282-1 of elongated opening 278-1 (see FIGS. 13 and 15).

More particularly, in the present embodiment wherein stir bar 224 has four paddles, guide portion 226 is configured to position the rotational axis 250 of stir bar 224 in a portion of the interior space of chamber 238 such that first distal end tip 270 of each the two pairs of diametrically opposed paddles alternatingly and intermittently are positioned to face in a direction toward inlet and outlet fluid ports 242, 244; fluid channel 246; and fluid opening 232-3, as stir bar 224 is rotated.

Those skilled in the art will recognize that the actual configuration of stir bar 224 may be modified in various ways, without departing from the scope of the present invention. For example, it is contemplated that shape and/or size of the plurality of paddles of stir bar 224 may be varied from the express example set forth herein. Also, it is contemplated that second tier portion 266 of stir bar 224 (see FIG. 20) may be formed as a continuous circular hub.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A fluidic dispensing device, comprising:

a housing having an exterior wall and a fluid reservoir, the exterior wall having a chip mounting surface defining a first plane and having a first opening, the fluid reservoir being in fluid communication with the first opening;

an ejection chip mounted to the chip mounting surface of the housing, the ejection chip being in fluid communication with the first opening, the ejection chip having a plurality of ejection nozzles oriented such that a fluid ejection direction is substantially orthogonal to the first plane;

a stir bar moveably confined within the fluid reservoir, the stir bar having a plurality of paddles and a rotational axis, with each of the plurality of paddles having a free end tip that intermittently faces toward the first opening that is in fluid communication with the ejection chip as the stir bar is rotated about the rotational axis; and a guide portion contained in the housing to locate the stir bar within a predetermined portion of the fluid reservoir and to facilitate movement of the stir bar in at least one direction substantially perpendicular to the rotational axis of the stir bar.

2. The fluidic dispensing device of claim 1, wherein the rotational axis has an orientation that is substantially perpendicular to the fluid ejection direction.

3. The fluidic dispensing device of claim 1, wherein the fluid reservoir has a chamber having an interior perimetrical wall having at least one port in fluid communication with the first opening, the stir bar being laterally and longitudinally located within the fluid reservoir within a boundary defined by the interior perimetrical wall.

4. The fluidic dispensing device of claim 1, wherein the fluid reservoir has a chamber having an interior perimetrical wall and a base wall, the interior perimetrical wall of the chamber having an extent bounded by a proximal end and a distal end, the proximal end being contiguous with a base wall and the distal end defines a perimetrical end surface at a lateral opening of the chamber, and fluid reservoir further including:

a diaphragm engaged in sealing engagement with the perimetrical end surface, the chamber and the diaphragm cooperating to define a fluid reservoir having a variable volume, the chamber and the diaphragm defining confining surfaces of the fluid reservoir, the stir bar being confined for movement within the variable volume by the confining surfaces of the fluid reservoir.

5. The fluidic dispensing device of claim 1, the housing having a base wall, the guide portion including a confining member having a guide opening and an axial confining surface, the guide opening defines an interior radial confining surface that engages the stir bar, the guide opening facilitates radial movement of the stir bar in a direction substantially perpendicular to the rotational axis, the axial confining surface being axially displaced from the base wall along the rotational axis, at least a portion of the stir bar being positioned between the axial confining surface and the base wall.

6. The fluidic dispensing device of claim 1, wherein the fluid reservoir is defined by a chamber and a diaphragm, the diaphragm being in sealing engagement with the chamber to define a variable volume of the fluid reservoir, the stir bar being located in the variable volume, and the guide portion being located within the variable volume to confine the stir bar for movement within a predefined portion of the variable volume.

7. A fluidic dispensing device, comprising:

a housing having an exterior wall and a fluid reservoir, the fluid reservoir having a chamber, the exterior wall having a chip mounting surface defining a first plane and having a first opening, the fluid reservoir being in fluid communication with the first opening;

an ejection chip mounted to the chip mounting surface of the housing, the ejection chip being in fluid communication with the first opening, the ejection chip having a plurality of ejection nozzles oriented such that a fluid ejection direction is substantially orthogonal to the first plane;

a stir bar moveably confined within the fluid reservoir, the stir bar having a plurality of paddles and a rotational axis, with each of the plurality of paddles having a free end tip that intermittently faces toward the first opening that is in fluid communication with the ejection chip as the stir bar is rotated about the rotational axis; and a guide portion located in the chamber, the guide portion having a confining member having a guide opening that facilitates radial movement of the stir bar in a direction substantially perpendicular to the rotational axis of the stir bar.

8. The fluidic dispensing device of claim 7, wherein the guide opening is an elongated opening that has a longitudinal extent and a lateral extent perpendicular to the longitudinal extent, the longitudinal extent being greater than the lateral extent.

9. The fluidic dispensing device of claim 7 wherein the guide opening is an elongated opening that has a longitudinal extent in a direction toward the first opening of the exterior wall.

10. The fluidic dispensing device of claim 7, wherein the guide opening is an elongated opening that has a longitudinal extent in a direction toward the first opening of the exterior wall to facilitate movement of the stir bar toward or away from the ejection chip.

* * * * *